US012532910B2

(12) United States Patent
Skelly

(10) Patent No.: US 12,532,910 B2
(45) Date of Patent: Jan. 27, 2026

(54) CARTRIDGE CIGARETTE FILTER

(71) Applicant: William R. Skelly, Toronto (CA)

(72) Inventor: William R. Skelly, Toronto (CA)

( * ) Notice: Subject to any disclaimer, the term of this patent is extended or adjusted under 35 U.S.C. 154(b) by 0 days.

(21) Appl. No.: 18/634,569

(22) Filed: Apr. 12, 2024

(65) Prior Publication Data

US 2025/0318574 A1 Oct. 16, 2025

(51) Int. Cl.
*A24D 3/04* (2006.01)
*A24D 3/06* (2006.01)
*A24D 3/18* (2006.01)

(52) U.S. Cl.
CPC ..... *A24D 3/04* (2013.01); *A24D 3/06* (2013.01); *A24D 3/18* (2013.01)

(58) Field of Classification Search
CPC .... A24D 3/04; A24D 3/06; A24D 3/18; A24F 7/04; A24F 13/02; A24F 13/04; A24F 13/06
USPC ..... 131/175, 187
See application file for complete search history.

(56) References Cited

U.S. PATENT DOCUMENTS 3,137,303 A * 6/1964 Shaw ..... A24F 13/06 131/179
4,327,748 A * 5/1982 Divis ..... A24F 13/02 131/206
4,370,988 A * 2/1983 Terasaki ..... A24F 13/06 131/201
5,178,165 A * 1/1993 DeFelice ..... A24F 13/06 131/198.1
2013/0112216 A1* 5/2013 Clarke ..... A24D 3/04 131/331
2018/0140004 A1 5/2018 Lu
(Continued)

FOREIGN PATENT DOCUMENTS

CA 2949484 C 5/2022
EP 2328432 A1 6/2011
(Continued)

OTHER PUBLICATIONS

Ganpati Enterprises, Dhanbad, Cigarette Filter Rolling Paper Tips, retrieved from Internet, retrieved on Apr. 12, 2024, <URL: https://m.indiamart.com/proddetail/cigarette-filter-rolling-paper-tips-23067151412.html>.
(Continued)

*Primary Examiner* — Dionne W. Mayes

(57) ABSTRACT

A cartridge cigarette filter includes a cylindrical sleeve, a tipping paper layer, a fiber filter body, and at least one hermetic locking feature. The cylindrical sleeve configured with a mouth end, a cigarette end, an outer surface, and an inner surface. The mouth end is adjacently and concentrically connected to the cigarette end. The outer surface is externally extended from the mouth end to the cigarette end, and the inner surface is internally extended from the mouth end to the cigarette end. The tipping paper is superimposed onto the outer surface and extended from the mouth end to the cigarette end. The filter body is connected to the inner surface and concentrically positioned within the mouth end. The hermetic locking feature is integrated onto the inner surface and concentrically positioned within the cigarette end to facilitate an airtight attachment between the cigarette and the cylindrical sleeve.

6 Claims, 6 Drawing Sheets

(56) References Cited

U.S. PATENT DOCUMENTS

| | | | | |
|---|---|---|---|---|
| 2021/0378292 | A1 | 12/2021 | Prog et al. | |
| 2024/0180234 | A1* | 6/2024 | Holford | A24F 40/20 |

FOREIGN PATENT DOCUMENTS

| | | | |
|---|---|---|---|
| EP | 2339933 | B1 | 11/2012 |
| EP | 4032416 | A1 | 7/2022 |

OTHER PUBLICATIONS

Greengo, 1000 Greengo Biodegradable organic ECO unbleached Slim 6mm filter tips, retrieved from Internet, retrieved on Apr. 12, 2024, <URL: https://www.amazon.com/Greengo-Biodegradable-Organic-Unbleached-Filter/dp/B07Q3N7FHF>.

Hornet, Natural Rolling Paper Tips Pre Rolled Cigarette Filter 7 MM Rolling Filter Custom Filter Tips S type, retrieved from Internet, retrieved on Nov. 1, 2023, <URL: https://www.alibaba.com/product-detail/Natural-Rolling-Paper-Tips-Pre-Rolled_1600834968459.html>.

Aryshaa, (Pack of 20 Pcs) Cigarette Filter for Smoking Multi Functional Plastic Smoking Water/Tobacco Pipe Hookah Filter, retrieved from Internet, retrieved on Apr. 12, 2024, <URL: https://www.amazon.in/Cigarette-Smoking-Functional-Plastic-Tobacco/dp/B09Z2WTQKD>.

* cited by examiner

CARTRIDGE CIGARETTE FILTER

FIELD OF THE INVENTION

The present invention is generally related to cigarette accessories. More specifically, the present invention is a cartridge cigarette filter that attaches to the filtration end of a cigarette to provide secondary additional filtration to reduce the smoke intake of the cigarette consumer.

BACKGROUND OF THE INVENTION

A cigarette is a narrow cylindrical that is filled with a combustible material, typically tobacco, and rolled into thin paper for smoking. The cigarette is ignited at one end, causing it to smolder; the resulting smoke is orally inhaled via the opposite end. Cigarette smoking is the most common method of tobacco consumption. Current tobacco industry, cigarettes are made as filtered cigarettes and non-filtered cigarettes. Most modern cigarettes are filtered, so that various particles and chemicals can be trapped within the filter before inhaling. However, the integrated filter of the cigarette does not block all particles or other harmful chemicals that cause negative effects.

It is therefore an objective of the present invention to provide a cartridge cigarette filter that is able to function as an additional filtration process for the cigarette. More specifically, the present invention is a cylindrical sleeve that is integrated with a white fiber filter body that attaches to the mouth end of the cigarette. As a result, the present invention is able to provide additional filtration process for the cigarette smoking process by utilizing a standard white fiber filter. Furthermore, the cigarette can hermetically attach to the present invention via a hermetically locking feature to prevent outside air from entering into the cylindrical sleeve. As a result, the present invention is able to function as a secondary filtration apparatus to the cigarette without hindering the smoking experience.

DETAILED DESCRIPTION OF THE INVENTION

All illustrations of the drawings are for the purpose of describing selected versions of the present invention and are not intended to limit the scope of the present invention.

Figure 1:
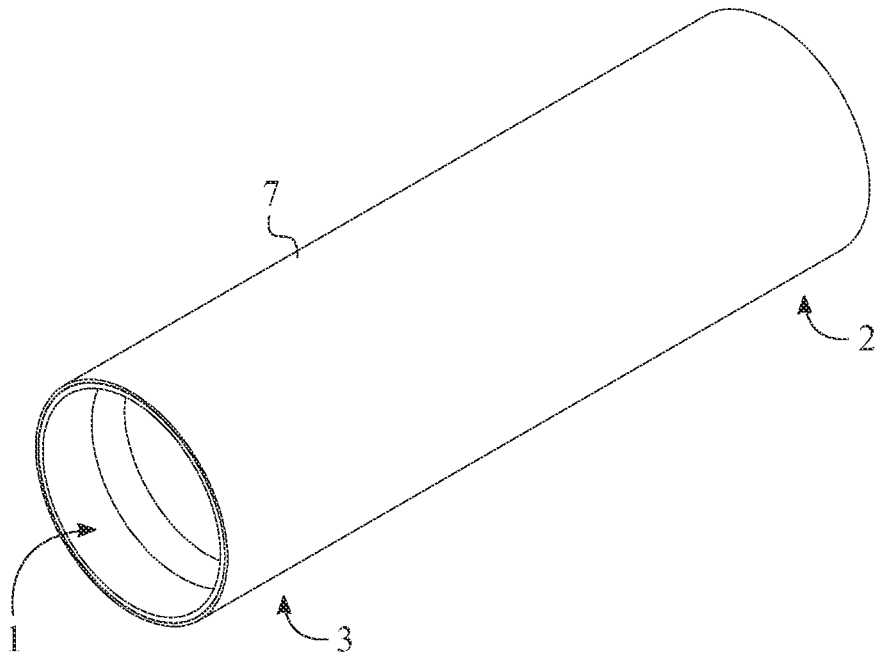
FIG. 1 is a top perspective view of the present invention.
Figure 2:
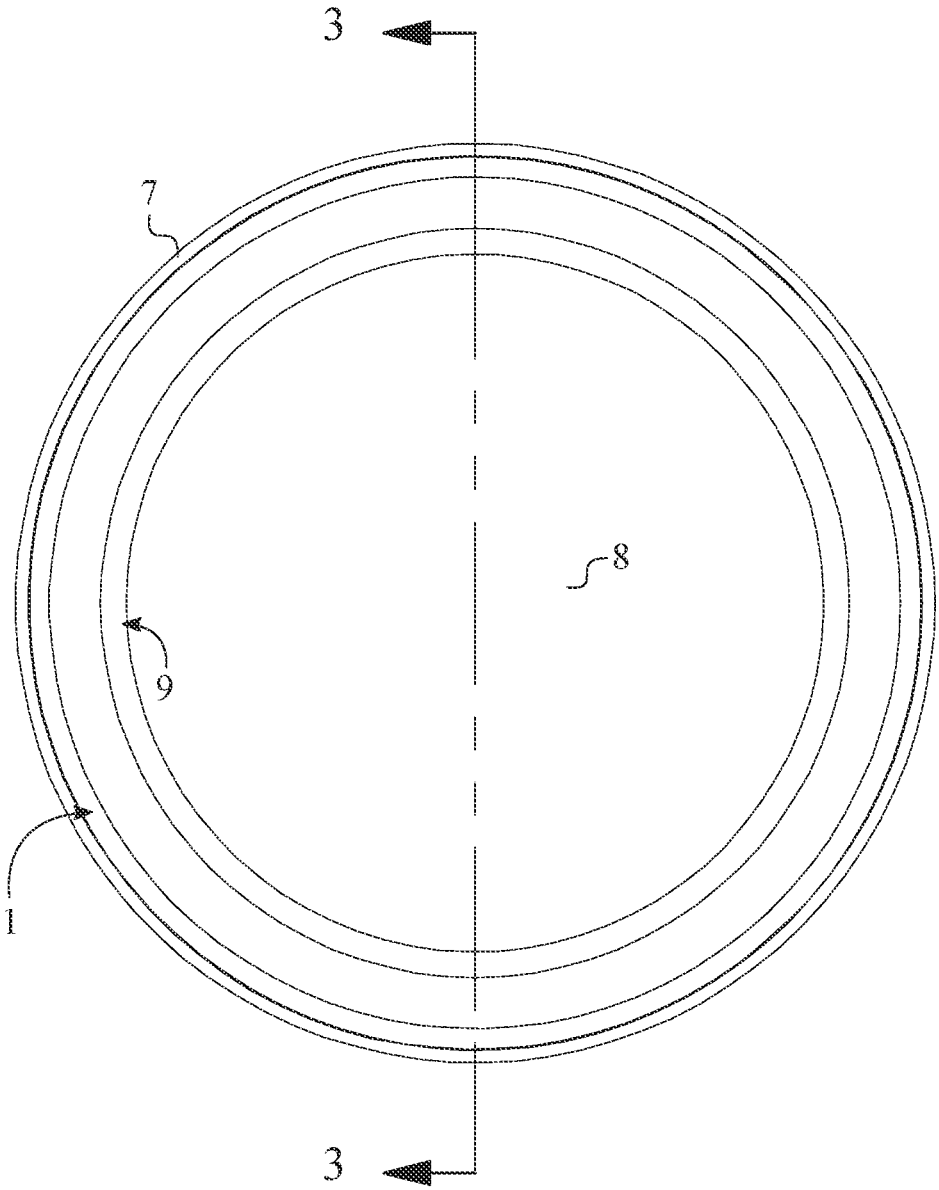
FIG. 2 is a front view of the present invention.

The present invention is a cartridge cigarette filter that is attachable to the mouth end of any standard cigarette. Due to the component configuration, the present invention easily and conveniently provides a secondary filtration to reduce the overall smoke/vapor intake of the cigarette user. As shown in FIG. 1 and FIG. 2, the present invention comprises a cylindrical sleeve 1, a tipping paper layer 7, a filter body 8, and at least one hermetic locking feature 9.

Figure 3:
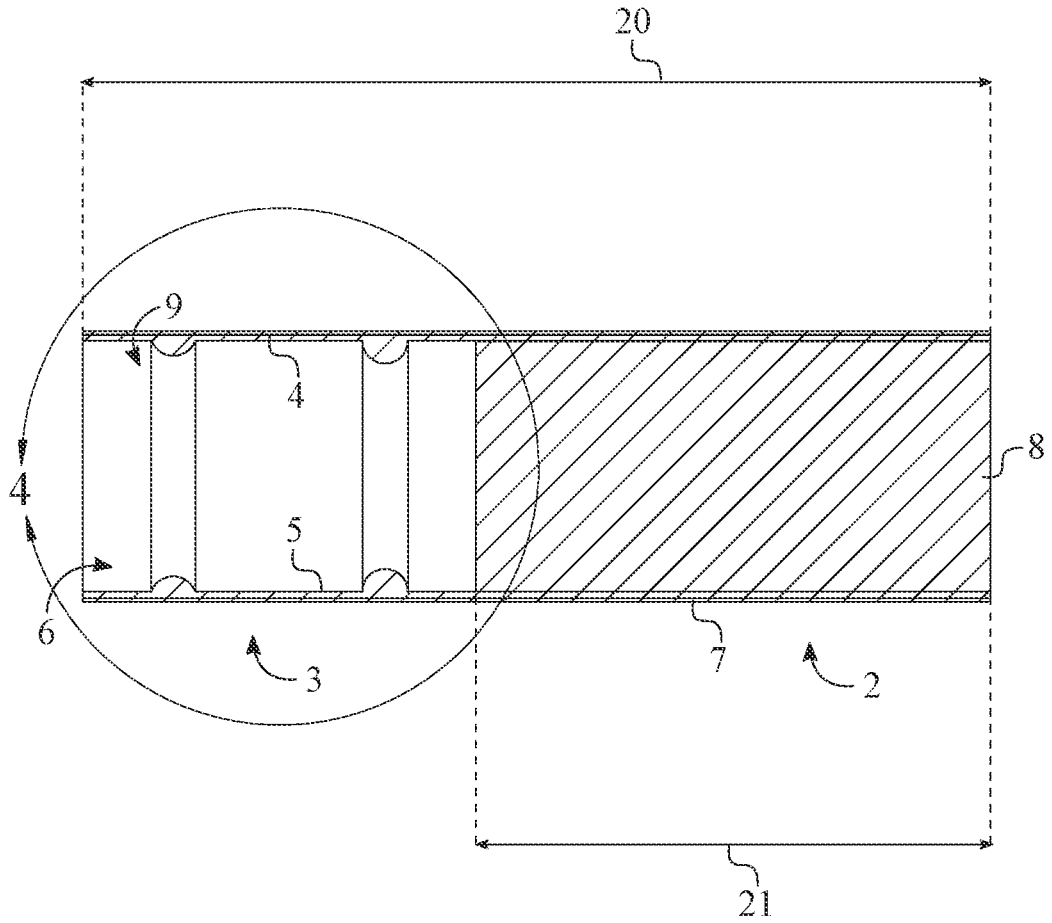
FIG. 3 is a cross-sectional view taken along line 3-3 in FIG. 2.

In reference to the general configuration, as shown in FIGS. 1-3, the filter body 8 is internally connected to one end of the cylindrical sleeve 1 as the mouth end of the standard cigarette can be inserted into the opposite end of cylindrical sleeve 1. The tipping paper layer 7 is wrapped around the cylindrical sleeve 1 so that the appearance of the present invention matches with the appearance of the standard cigarette. The hermetic locking feature 9 is internally integrated onto the cylindrical sleeve 1 so that the user can snugly insert and fit the standard cigarette into the cylindrical sleeve 1 with an airtight attachment.

The cylindrical sleeve 1 functions as the main structural component of the present invention as the rest of the components are positioned with respect to the cylindrical sleeve 1. In reference to FIGS. 2-4, the cylindrical sleeve 1 is an elongated tubular body and comprises a mouth end 2, a cigarette end 3, an outer surface 4, an inner surface 5, and an opening 6. The mouth end 2 is adjacently and concentrically connected to the cigarette end 3 thus defining the overall shape of the cylindrical sleeve 1. The outer surface 4 is externally extended from the mouth end to the cigarette end 3, and the inner surface 5 is internally extended from the mouth end 2 to the cigarette end 3. The cylindrical sleeve 1 is preferably made of card stock paper or any other material that can withhold the circular cross-sectional shape of the cylindrical sleeve 1. The opening 6 is concentrically positioned to the cigarette end 3 and provides the necessary space to insert the mouth end of the standard cigarette.

Figure 4:
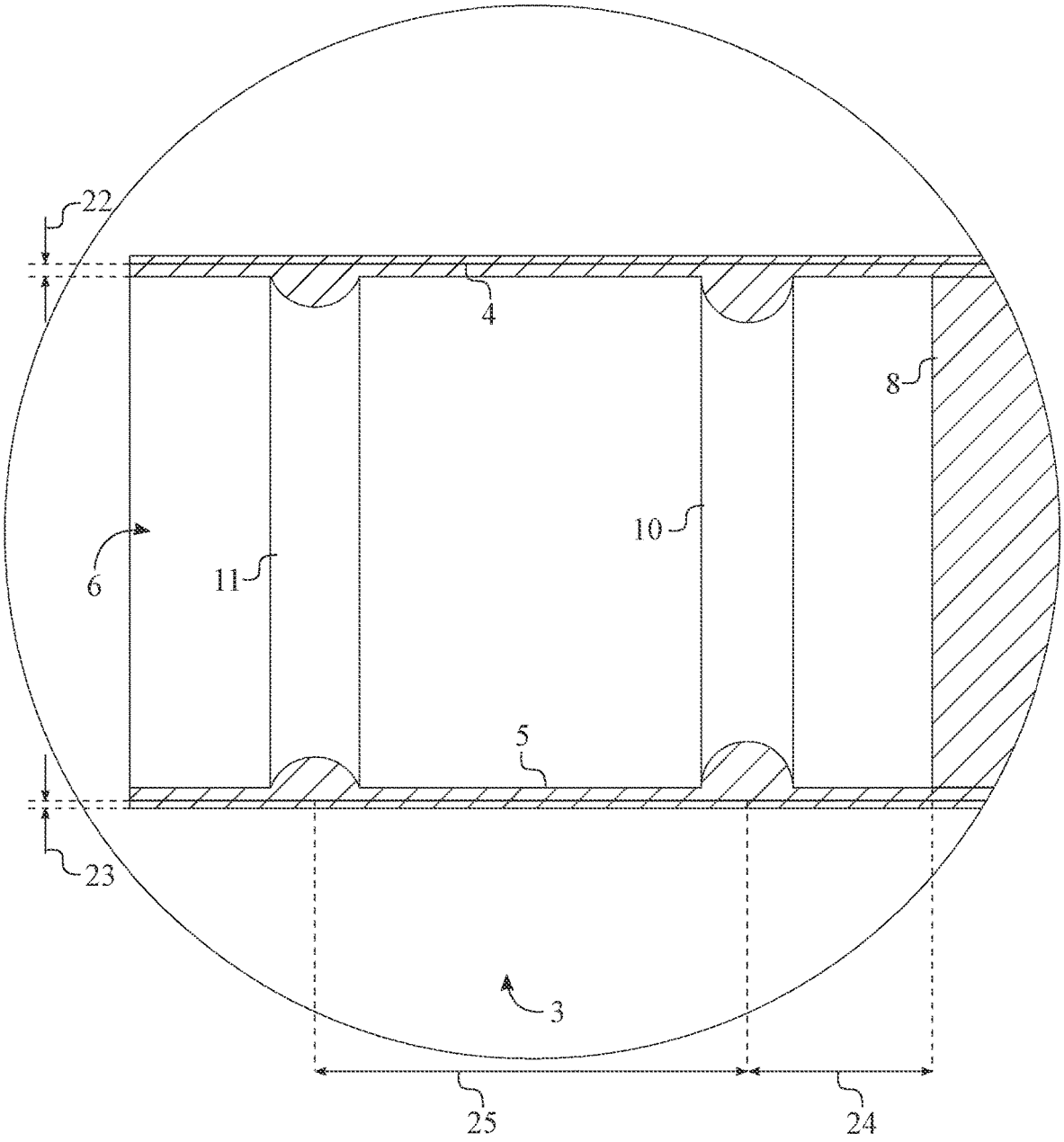
FIG. 4 is a detailed view taken about circle 4 in FIG. 3, showing the proximal compression ridge and the distal compression ridge.

In reference to a preferred embodiment of the present invention, the outer diameter of the cylindrical sleeve 1 is 8.82 millimeters (mm), and the inner diameter of the cylindrical sleeve 1 is 8.30 mm. As shown in FIG. 3, a sleeve length 20 of the present invention is delineated along the cylindrical sleeve 1 as the sleeve length 20 extends from the mouth end 2 to the cigarette end 3. The sleeve length 20 is 30 mm. As shown in FIG. 4, a first thickness 22 of the present invention delineates the thickness of the cylindrical sleeve 1 as the first thickness 22 ranges from 0.10 mm to 0.24 mm. Even though the aforementioned dimensions are explained in relation to the preferred embodiment, it is understood that the outer diameter, the inner diameter, and the first thickness 22 can be altered to accommodate different sized cigarettes.

The tipping paper layer 7 enhances the appearance of the present invention and matches with the external appearance of the standard cigarette. Furthermore, the tipping paper layer 7 is able to enhance the structural integrity of the cylindrical sleeve 1. In reference to FIG. 2 and FIG. 3, the tipping paper layer 7 is superimposed onto the outer surface 4 and extended from the mouth end 2 to the cigarette end 3. As a result, the tipping paper layer 7 is able to fully cover the outer surface 4 of the cylindrical sleeve 1.

In reference to the preferred embodiments of the present invention, as shown in FIG. 4, a second thickness 23 of the present invention delineates the thickness of the tipping paper layer 7 as the second thickness 23 ranges from 0.08 mm to 0.15 mm. Even though the second thickness 23 is explained in relation to the preferred embodiment, it is understood that the second thickness 23 can be altered to accommodate different sized cigarettes.

The filter body 8 is a white fiber filter that is generally utilized within the tobacco industry so that the filter body 8 is able to remove additional smoke particles and chemicals from the inhaled smoke. In reference to FIG. 2 and FIG. 3, the filter body 8 is connected to the inner surface 5, and the filter body 8 is concentrically positioned and extended within the mouth end 2.

In reference to the preferred embodiments of the present invention, as shown in FIG. 3, a filter length 21 of the present invention delineates the overall length of the filter body 8 as the filter length 21 ranges is 17 mm. Even though the filter length 21 is explained in relation to the preferred embodiment, it is understood that the filter length 21 can be altered to accommodate different sized cigarettes.

In reference to FIG. 1 and FIG. 2, the hermetic locking feature 9 is integrated onto the inner surface 5 and concentrically positioned within the cigarette end 3. In other words, the hermetic locking feature 9 is integrated onto the internal circumference of the cylindrical sleeve 1 so that the mouth end of the standard cigarette can be hermetically attached to the cylindrical sleeve 1. As a result, the hermetic locking feature 9 prevents surrounding air from entering into the cylindrical sleeve 1 through the opening 6 of the cigarette end 3.

As shown in FIG. 3 and FIG. 4, the hermetic locking feature 9 may comprise a proximal compression ridge 10 and a distal compression ridge 11 to snugly fit the standard cigarette into the cigarette end 3. The proximal compression ridge 10 is connected onto the inner surface 5 of the cigarette end 3. The distal compression ridge 11 is connected onto the inner surface 5 of the cigarette end 3. Preferably, the proximal compression ridge 10 and the distal compression ridge 11 are pressure rolled or stamped into the inner surface 5 during the manufacturing process. The proximal compression ridge 10 and the distal compression ridge 11 are positioned within the cigarette end 3 to provide an air seal to prevent excess air from entering into the opening 6 while the standard cigarette is being smoked. More specifically, the proximal compression ridge 10 is positioned adjacent to the filter body 8. The distal compression ridge 11 is positioned offset from the filter body 8 as the proximal compression ridge 10 is positioned in between the distal compression ridge 11 and the filter body 8. When the standard cigarette is inserted into the cigarette end 3, the standard cigarette first snugly fits within the distal compression ridge 11. Then, the standard cigarette glides over the distal compression ridge 11 and snugly fits within the proximal compression ridge 10 thus providing two different compression points to prevent excess air from entering.

In reference to the preferred embodiments of the present invention, as shown in FIG. 4, a first distance 24 of the present invention is measured from the filter body 8 to a center of the proximal compression ridge 10. The first distance 24 is 3 mm thus positioning the proximal compression ridge 10 adjacent to the filter body 8. A second distance 25 of the present invention is measured from the center of the proximal compression ridge 10 to a center of the distal compression ridge 11. The second distance 25 is 7 mm thus positioning the distal compression ridge 11 offset from the filter body 8. Preferably, the proximal compression ridge 10 and the distal compression ridge 11 are formed into a semi-circular shape. As a result of the semi-circular shape, the width of the proximal compression ridge 10 and the distal compression ridge 11 can range from 1 mm to 1.5 mm, and the depth/height of the proximal compression ridge 10 and the distal compression ridge 11 can range from 0.5 mm to 1 mm. Even though the aforementioned dimensions are explained in relation to the preferred embodiment, it is understood that the width of the proximal compression ridge 10, the width of the distal compression ridge 11, the depth of the proximal compression ridge 10, and the depth of the distal compression ridge 11 can be altered to accommodate different sized cigarettes.

Figure 5:
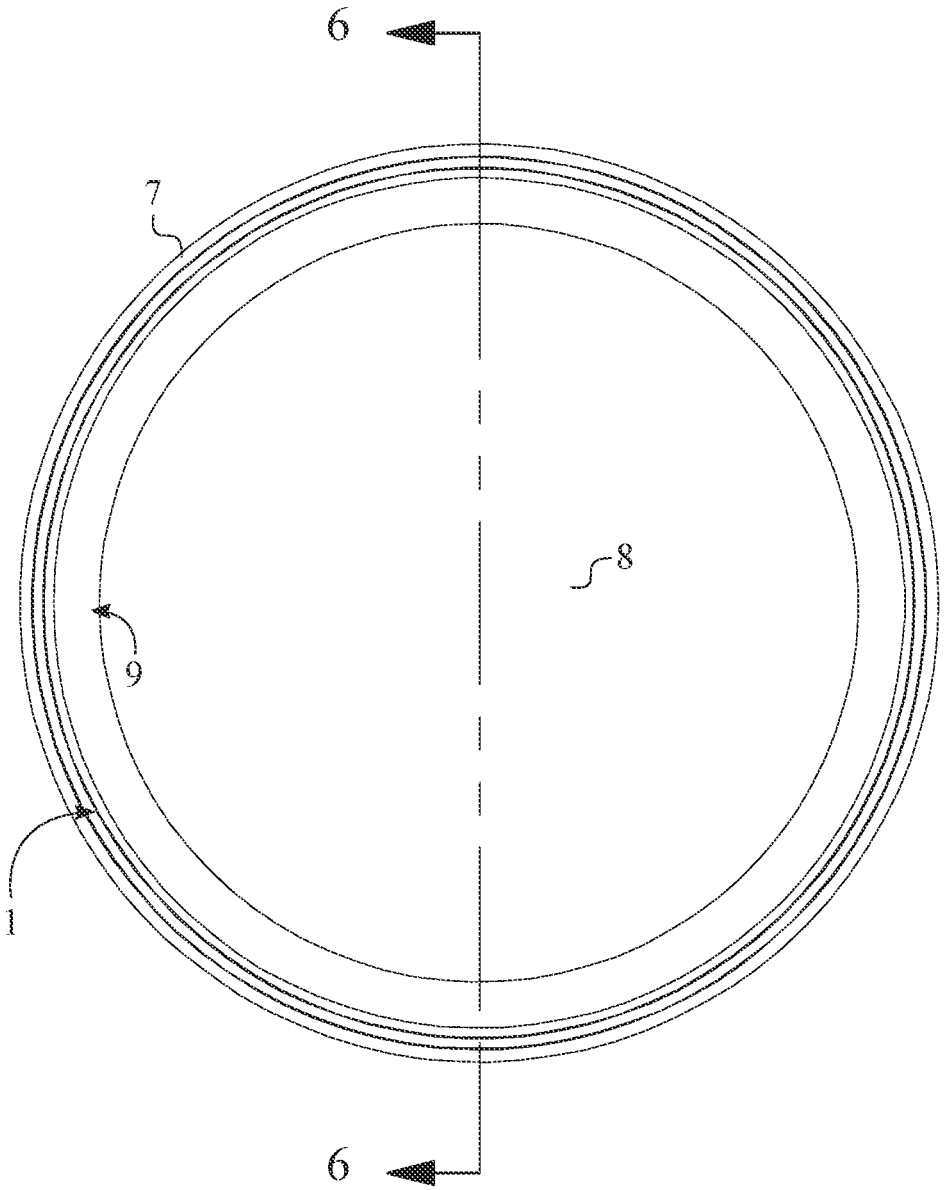
FIG. 5 is a front view of the present invention.
Figure 6:
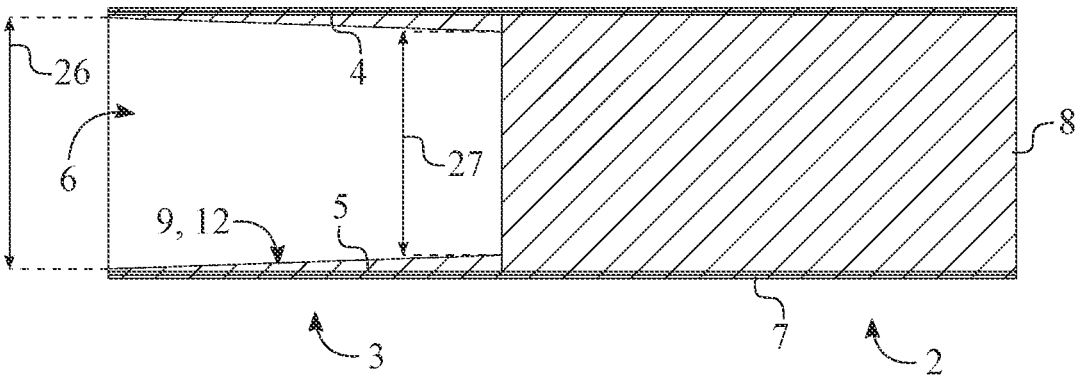
FIG. 6 is a cross-sectional view taken along line 6-6 in FIG. 5.

As shown in FIG. 5 and FIG. 6, the hermetic locking feature 9 may comprise an inwardly tapered sleeve 12 that is concentrically connected onto the inner surface 5 of the cigarette end 3. In other words, the inwardly tapered sleeve 12 fully extends along the cigarette end 3 as the inwardly tapered sleeve 12 gets narrower from the opening 6 of the cigarette end 3 to the filter body 8. As a result, the inwardly tapered sleeve 12 is able to grip the standard cigarette tightly to provide an air seal to prevent excess air from entering through the opening 6 while the standard cigarette is being smoked. The inwardly tapered sleeve 12 also allows the user to easily slide in their standard filter cigarettes to snugly fit within the cigarette end 3.

In reference to the preferred embodiments of the present invention, as shown in FIG. 6, a first inner diameter 26 of the inwardly tapered sleeve 12 is positioned adjacent to the opening 6 of the cigarette end 3 and is measured 8.29 mm. A second inner diameter 27 of the inwardly tapered sleeve 12 is positioned adjacent to the filter body 8 and is measured 7.4 mm. Even though the first inner diameter 26 and the second inner diameter 27 are explained in relation to the preferred embodiment, it is understood that the first inner diameter 26 and the second inner diameter 27 can be altered to accommodate different sized cigarettes.

The present invention can preferably be used up to 6 times before disposing, depending upon the type of cigarettes being smoked by the consumer.

Although the invention has been explained in relation to its preferred embodiment, it is to be understood that many other possible modifications and variations can be made without departing from the spirit and scope of the invention as hereinafter claimed.

What is claimed is:

1. A cartridge cigarette filter comprising:

a cylindrical sleeve;

a tipping paper layer;

a filter body;

at least one hermetic locking feature;

the cylindrical sleeve comprising a mouth end, a cigarette end, an outer surface, an inner surface, and an opening;

the at least one hermetic locking feature comprising a proximal annular compression ridge and a distal annular compression ridge;

the mouth end being adjacently and concentrically connected to the cigarette end;

the outer surface being externally extended from the mouth end to the cigarette end;

the inner surface being internally extended from the mouth end to the cigarette end;

the opening being concentrically positioned to the cigarette end;

the tipping paper layer being superimposed onto the outer surface;

the tipping paper layer being extended from the mouth end to the cigarette end;

the filter body being connected to the inner surface;

the filter body being concentrically positioned within the mouth end;

the at least one hermetic locking feature being integrated onto the inner surface;

the at least one hermetic locking feature being concentrically positioned within the cigarette end;

a first thickness of the cylindrical sleeve ranging from 0.10 millimeters (mm) to 0.24 mm;

the cylindrical sleeve being made from card stock paper;

the proximal annular compression ridge being connected onto the inner surface of the cigarette end;

the distal annular compression ridge being connected onto the inner surface of the cigarette end;

the proximal annular compression ridge being positioned adjacent to the filter body;

the distal annular compression ridge being positioned offset from the filter body;

the proximal annular compression ridge being positioned in between the distal annular compression ridge and the filter body;

a transversal cross-section of the proximal annular compression ridge and a transversal cross-section of the distal annular compression ridge being an arc shape;

a proximal tangent line to the transversal cross-section of the proximal annular compression ridge and a distal tangent line to the transversal cross-section of the distal annular compression ridge being positioned parallel to the inner surface;

the proximal tangent line being positioned further from the inner surface than the distal tangent line;

the proximal annular compression ridge being made of a first annular compressed portion of the card stock paper;

the distal annular compression ridge being made of a second annular compressed portion of the card stock paper; and the proximal annular compression ridge and the distal annular compression ridge being hermetically positioned around a cigarette as a filter portion of the cigarette traverses through the cigarette end, through the distal annular compression ridge, and through the proximal compression ridge providing two different compression points along a length of the cigarette so as to prevent excess air from entering the sleeve.

2. The cartridge cigarette filter as claimed in claim 1 comprising:

a sleeve length;

the sleeve length being delineated along the cylindrical sleeve; and the sleeve length being 30 mm.

3. The cartridge cigarette filter as claimed in claim 1 comprising:

a filter length;

the filter length being delineated along the filter body; and the filter length being 17 mm.

4. The cartridge cigarette filter as claimed in claim 1, wherein a second thickness of the tipping paper layer ranges from 0.08 mm to 0.15 mm.

5. The cartridge cigarette filter as claimed in claim 1, wherein a first distance from the filter body to a center of the proximal annular compression ridge is 3 mm.

6. The cartridge cigarette filter as claimed in claim 1, wherein a second distance from a center of the proximal annular compression ridge to a center of the distal compression ridge is 7 mm.

* * * * *